US005133512A

United States Patent [19]

Mondini et al.

[11] Patent Number: 5,133,512

[45] Date of Patent: Jul. 28, 1992

[54] LAP WINDER FOR PRODUCING LAPS FROM SLIVERS

[75] Inventors: Giancarlo Mondini; Paul Scheurer, both of Winterthur, Switzerland

[73] Assignee: Maschinenfabrik Rieter AG, Winterthur, Switzerland

[21] Appl. No.: 550,052

[22] Filed: Jul. 9, 1990

[30] Foreign Application Priority Data

Jul. 17, 1989 [CH] Switzerland ..... 02-670/89-2

[51] Int. Cl.[5] ..... B65H 18/08

[52] U.S. Cl. ..... 242/66

[58] Field of Search ..... 242/65, 66, 67.1 R, 242/67.2, 67.5; 474/84, 85, 86; 19/157, 161.1; 28/116, 117, 134; 139/308

[56] References Cited

U.S. PATENT DOCUMENTS

| | | | |
|---|---|---|---|
| 1,266,942 | 5/1918 | Henderson | 242/66 |
| 1,838,967 | 12/1931 | Staege | 242/66 |
| 2,858,997 | 11/1958 | Rockstrom | 242/66 |
| 2,890,000 | 6/1959 | Beachler | 242/66 |
| 2,980,356 | 4/1961 | Beese et al. | 242/66 |
| 3,000,584 | 9/1961 | Clem | 242/66 |
| 3,258,136 | 6/1966 | Rockstrom et al. | 214/1 |
| 3,377,033 | 4/1968 | Link | 242/66 |
| 3,433,429 | 3/1969 | Schnitzspahn | 242/65 |
| 3,433,430 | 3/1969 | Sprague | 139/308 X |
| 3,450,364 | 12/1969 | Marsh et al. | 242/66 |
| 3,460,204 | 8/1969 | Howes et al. | 19/23 |
| 3,865,324 | 2/1975 | Binder | 242/67.1 R |
| 4,377,260 | 3/1983 | Huffman | 474/86 X |

FOREIGN PATENT DOCUMENTS

| | | | |
|---|---|---|---|
| 505897 | 10/1951 | Belgium . | |
| 593859 | 3/1960 | Canada | 242/66 |
| 628864 | 10/1961 | Canada | 242/66 |
| 147035 | 5/1936 | Fed. Rep. of Germany | 242/66 |
| 1083718 | 6/1960 | Fed. Rep. of Germany . | |
| 1183325 | 7/1959 | France . | |
| 1216090 | 4/1960 | France | 242/66 |

*Primary Examiner*—Daniel P. Stodola
*Assistant Examiner*—John P. Darling
*Attorney, Agent, or Firm*—Sandler, Greenblum & Bernstein

[57] ABSTRACT

The lap winder has two rotatable lap rollers which support a lap during winding. A drive motor drives the lap rollers through the intermediary of a transmission or gearing. A brake mechanism acts on at least one of the lap rollers or on an element co-rotating or fixedly connected for rotation with one of the lap rollers. When the lap winder stops then the brake mechanism is actuated and takes-up the kinetic energy of the lap rollers and that of the lap supported on the lap rollers. The braking forces for the lap rollers and for the lap therefore do not have to be transmitted through the transmission or gearing. There are thus avoided heavy loading and wear of the transmission or gearing.

11 Claims, 2 Drawing Sheets

LAP WINDER FOR PRODUCING LAPS FROM SLIVERS

BACKGROUND OF THE INVENTION

The present invention broadly relates to a new and improved construction of a lap winder or lap winding machine.

More specifically, the lap winder or lap winding machine serves for producing laps from slivers or the like. This lap winder further is of the type comprising two rotatable lap rollers for supporting a lap during winding and a drive motor for driving the lap rollers through the intermediary of a transmission or gearing.

Such types of lap winders or lap winding machines are known to the art. They are employed for the production of laps which are then fed to a combing machine. Slivers, for example, drafted slivers withdrawn from sliver cans, as a general rule are delivered by means of different transport or conveying rollers, a drafting arrangement and a roller calender to the lap which is supported upon the lap rollers of the lap winder. A common drive motor drives the conveying rollers, drafting arrangement and roller calender by means of individuals parts or elements of the transmission or gearing. When one of the infed slivers is missing or when the lap has reached a predetermined size, the lap winder is stopped, i.e. the drive motor is deactivated or stopped, and a brake which is either integrated into the drive motor or acts directly upon the motor shaft is operated since, in particular upon absence of the sliver there is desired a rapid stoppage of the lap winder.

When the lap is relatively large, for example, there are present 25 kilograms or more of batt at the lap and the operating speed is high, for instance, 120 m/min. batt speed which equals the lap circumferential velocity, then when the drive motor or drive motor shaft is braked, due to the kinetic energy of the lap rollers and the lap, there arises a heavy loading of the transmission or gearing elements or components between the drive motor and the lap rollers. This can lead to premature wear of the transmission or gearing elements.

SUMMARY OF THE INVENTION

Therefore, with the foregoing in mind, it is a primary object of the present invention to provide a new and improved construction of a lap winder or lap winding machine which does not suffer from the aforementioned drawbacks and shortcomings of the prior art constructions.

It is another and more specific object of the present invention to provide an improved construction of a lap winder or lap winding machine which avoids such heavy loading or stressing and premature wear of the transmission or gearing elements in the lap winder or lap winding machine.

Now in order to implement these and still further objects of the invention which will become more readily apparent as the description proceeds, the lap winder or lap winding machine of the present development, among other things, is manifested by the features that there is provided at least one brake mechanism or device which selectively acts directly upon at least one of the lap rollers or an element which co-rotates or is fixedly connected for rotation with the aforesaid one of the lap rollers.

The brake mechanism is therefore arranged at that location where there is present the largest centrifugal or gyrating mass which is to be braked, namely the lap rollers and the lap. Consequently, the kinetic energy of the lap rollers and the lap which is released during the braking operation, need no longer be transmitted to the drive motor through parts or elements or the transmission or gearing. As a result, there is obviated the heavy or pronounced loading of these transmission or gearing elements. At the same time there is also possible a more rapid braking of the lap rollers.

Preferably a respective brake mechanism is operatively associated or correlated in the described manner with each of both lap rollers. However, it is also possible to provide only one of both lap rollers with a brake mechanism. In this case, then, both of the lap rollers are preferably coupled or connected as directly as possible with one another, for instance, by means of gears which are seated upon the shafts of both lap rollers and which are interconnected with one another by an endless transmission element, such as a chain or toothed belt.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DESCRIPTION OF THE PREFERRED EMBODIMENTS

Describing now the drawings, it is to be understood that to simplify the showing thereof, only enough of the construction of the lap winder or lap winding machine has been illustrated therein as is needed to enable one skilled in the art to readily understand the underlying principles and concepts of this invention.

Figure 1:
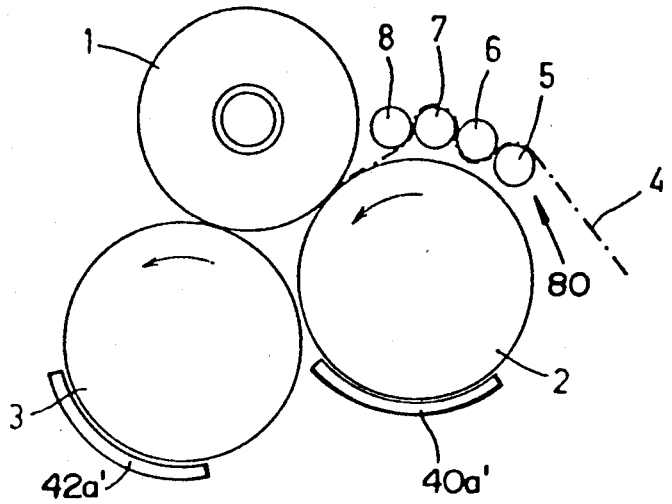
FIG. 1 schematically illustrates both of the lap rollers which support a lap or the like as well as a roller calender of a lap winder or lap winding machine.

Turning attention now to FIG. 1 there is shown therein a lap winder or lap winding machine wherein a lap 1 is carried on two lap rollers 2 and 3 of the lap winder. These lap rollers 2 and 3 are rotatable in the direction of the indicated arrows. A fiber fleece or batt 4, shown in chain-dotted lines, which has been formed in a not particularly illustrated but conventional drafting arrangement from a number of slivers, passes through a roller calender 80 composed of, for instance, four rollers 5, 6, 7 and 8 before it arrives at the lap 1 and is wound thereupon.

Figure 2:
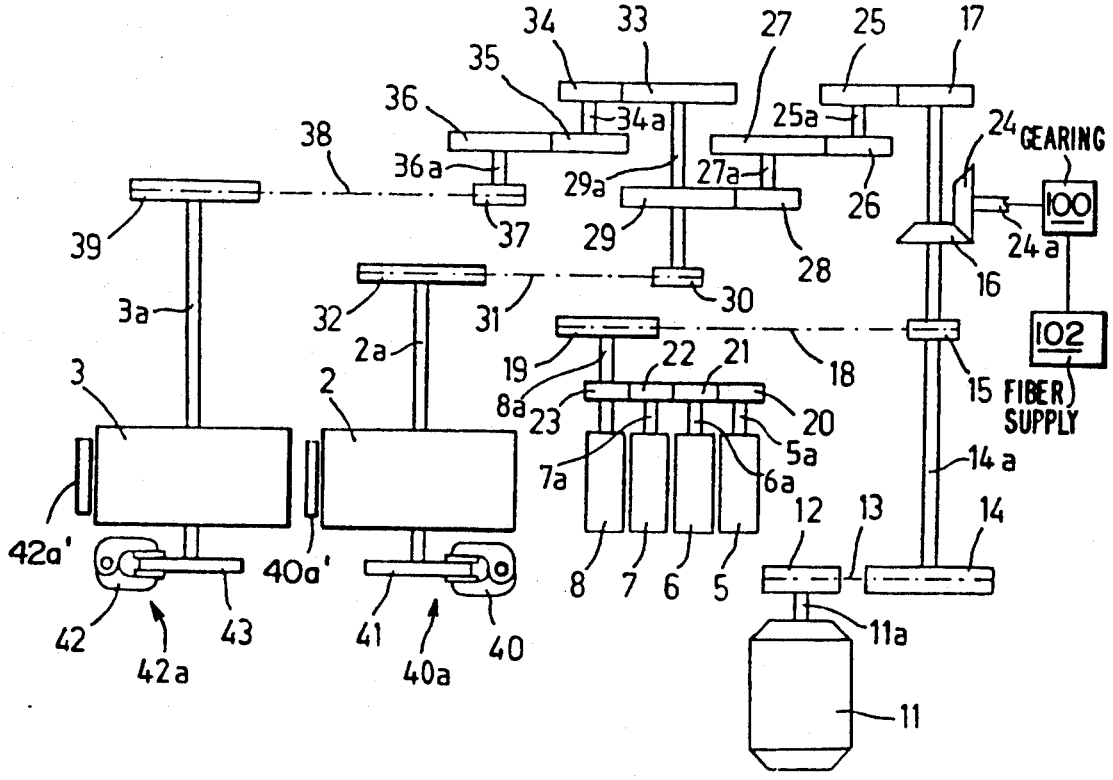
FIG. 2 illustrates a drive diagram for the lap rollers shown in FIG. 1.

FIG. 2 shows in a drive schematic or diagram a drive motor 11 of the lap winder or winding machine and the transmission or gearing parts or components for the drive of the lap rollers 2 and 3 and calender rollers or rolls 5, 6, 7 and 8. A belt pulley 12 seated upon the shaft 11*a* of the drive motor 11 is coupled by a belt or belt member 13 with a belt pulley 14. Seated upon the shaft 14*a* of the belt pulley 14 are three gears or gear members 15, 16 and 17. The gear 15 is connected by means of a suitable power transmitting or transmission element 18, such as a chain or a toothed belt, with a gear or gear member 19 seated upon the shaft 8a of the calender roller 8. The shafts 5a, 6a, 7a and 8a of the calender rollers 5, 6, 7 and 8, respectively, carry mutually intermeshing gears or gear members 20, 21, 22 and 23.

The gear or gear member 16 meshes with a gear or gear member 24, the shaft 24a of which drives transmission or gearing elements or parts 100 serving for the drive of transport or conveying rollers and the drafting arrangement of the lap winder, as indicated by reference numeral 102 generally indicating such fiber material supply means for the lap winder.

The gear 17 meshes with a gear or gear member 25 upon the shaft 25a of which there is seated a gear or gear member 26. The gears 25 and 26 can be exchanged for different gears so as to be able to alter the rotational speed of the lap rollers 2 and 3 in relation to the rotational speed of the calender rollers 5, 6, 7 and 8. The gear 26 meshes with a gear or gear member 27 upon the shaft 27a of which there is seated a gear or gear member 28 which meshes with a gear or gear member 29. Upon the shaft 29a of the gear 29 there is seated a gear or gear member 30 which is coupled by a suitable power transmitting or transmission element 31, here, for instance, a chain with a gear or gear member 32 seated upon the shaft 2a of the lap roller 2 and such gear 30 is also coupled by the shaft 29a with a gear or gear member 33. This gear 33 meshes with a gear or gear member 34 upon whose shaft 34a there is seated a gear or gear member 35. The gears 34 and 35 can be exchanged for different gears in order to vary the rotational speed of the lap roller 3 in relation to the rotational speed of the lap roller 2. The gear 35 meshes with a gear or gear member 36 upon the shaft 36a of which there is seated a gear or gear member 37. This gear 37 is connected by a suitable power transmitting or transmission element 38, here, for instance, a chain 38 with a gear or gear member 39 which is coupled to the shaft 3a of the lap roller 3.

A brake mechanism or device 40a for the lap roller 2 has a clamp or gripper 40 or equivalent structure which acts upon a disk or plate 41 rigidly connected for rotation with the shaft 2a of the lap roller 2.

In addition to the brake mechanism 40a or in lieu thereof, there can be provided a similar brake mechanism or device 42a having a clamp or gripper 42 or equivalent structure which acts upon a disk or plate 43 rigidly connected for rotation with the shaft 3a of the lap roller 3 and which is provided for this lap roller 3.

The schematically illustrated brake mechanisms 40a and 42a are thus here, for instance, disk brakes. However, it is of course possible to use other types of brake mechanisms. Yet, in any case the brake mechanisms or any other provided brake mechanisms should act directly upon at least one of the lap rollers 2 and 3, for instance, upon the peripheral surface of the corresponding lap roller as illustrated in FIGS. 1 and 2 for the brake mechanisms 40a' and 42a' or upon an element 41 and 43 which is rigidly or fixedly connected for rotation with the corresponding lap roller 2 and 3 as illustrated in FIGS. 1 and 2 for the above discussed brake mechanisms 40a and 42a. By way of completeness, it is here again remarked, and as already explained previously, the brake mechanisms 40a' and 42a' which directly act upon the lap rollers 2 and 3, respectively, as shown in FIG. 2, also can be correspondingly provided for the embodiments of FIGS. 3 and 4 where the showing thereof has been omitted to simply the illustration.

When the lap winder should be stopped, for instance, when one of the slivers delivered to the drafting arrangement is missing, then the drive motor 11 is cut-off or disengaged and the brake mechanism 40a and/or 42a activated. At the same time it is also possible to actuate a brake mechanism, such as the brake mechanism 40a' and/or 42a' or (not shown) which is integrated in the drive motor 11 or which acts upon the shaft 11a of this drive motor 11. The kinetic energy of the lap rollers 2 and 3 and the lap 1 is, however, taken up by the brake mechanisms 40a and 42a' or acting directly upon the lap rollers 2 and 3 or the shafts 2a and 3a thereof. In other words, the braking forces for the lap rollers 2 and 3 are not transmitted through the transmission or gearing parts or elements 12, 13, 14, 17, and 25 to 39.

As already explained, it is possible to use just one of the two brake mechanisms or devices 40a and 42a'. In such case, it is however advantageous to couple the two lap rollers 2 and 3 with one another through as few transmission or gearing elements as possible, in other words, to couple them as directly as possible to one another. Appropriate exemplary embodiments have been depicted schematically in FIGS. 3 and 4 in which the same or analogous components have been generally designated with the same reference characters as in FIG. 2.

Figure 3:
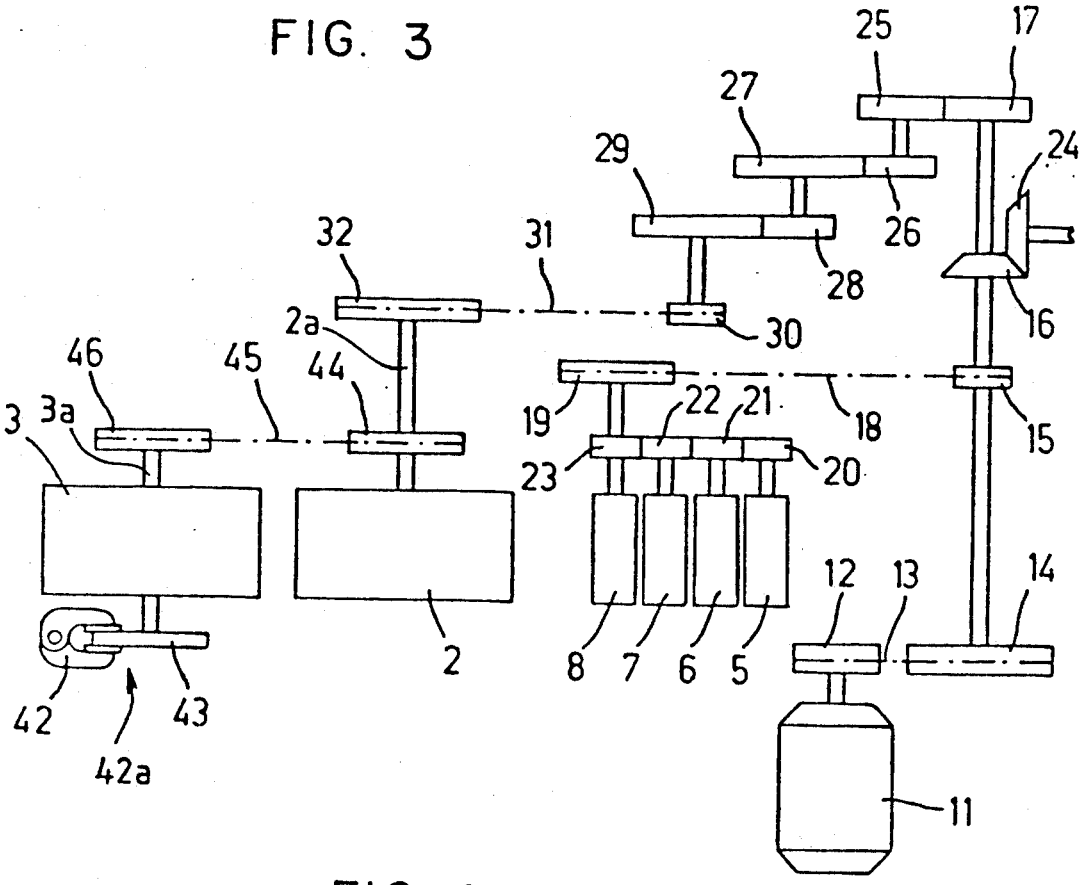
FIG. 3 illustrates a drive diagram for a second exemplary embodiment of the invention.

In the exemplary embodiment of FIG. 3 there is only present, for example, the brake mechanism 42a which acts upon the shaft 3a of the lap roller 3. Upon the shaft 2a of the lap roller 2 there is seated a gear or gear member 44 which is connected by a suitable power transmitting or transmission element 45, such as a chain or a toothed belt, with a gear or gear member 46 seated upon the shaft 3a of the lap roller 3. As a result, both of the lap rollers 2 and 3 are, of course, always mutually synchronously driven, and hence, the transmission or gearing elements or members 33 to 39, which in the embodiment of FIG. 2 drive the lap roller 3, here can be dispensed with. Of course, both of the gears 44 and 46 can be coupled with one another in a different fashion than by way of the depicted endless power transmission or transmitting element 45, for instance, by an intermediate gear (not shown) meshing with both of the gears 44 and 46.

Figure 4:
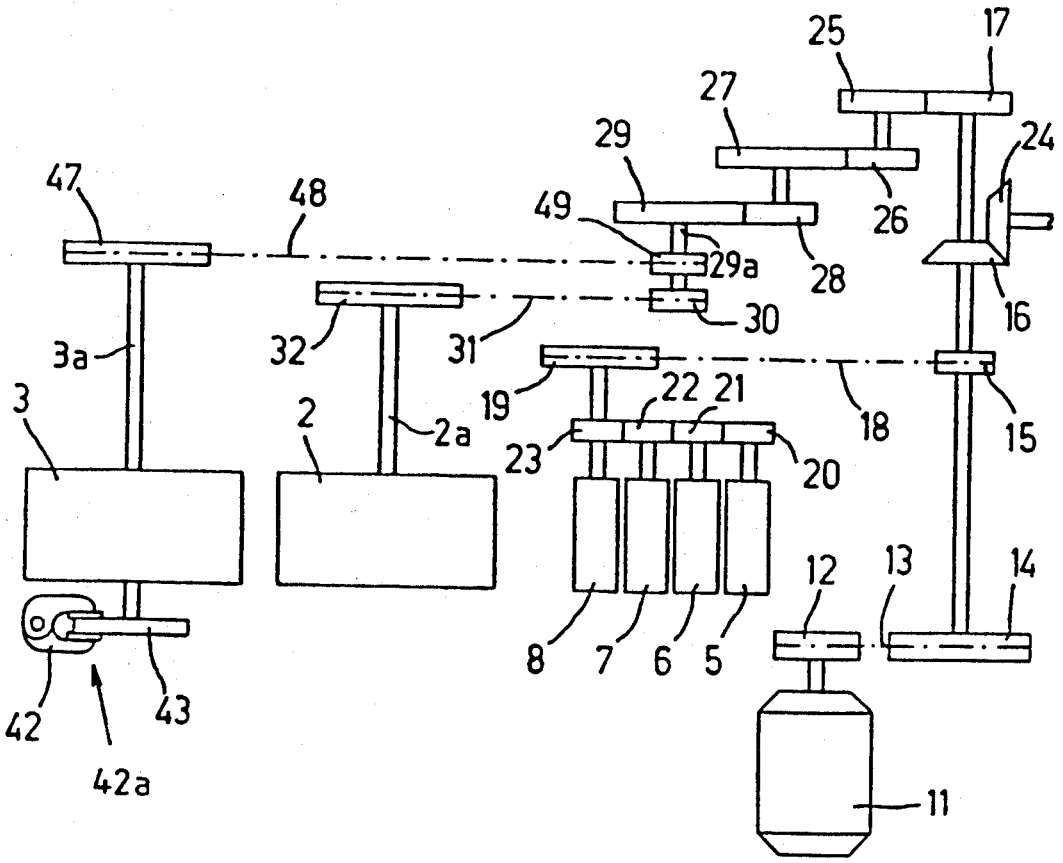
FIG. 4 illustrates a drive diagram for a third exemplary embodiment of the invention.

Also in the embodiment of FIG. 4 there is only provided, for example, the brake mechanism or device 42a for the lap roller 3. A gear or gear member 47 seated upon the shaft 3a of the lap roller 3 is coupled via a suitable power transmitting or transmission element 48, such as a chain or toothed belt 48, with a gear or gear member 49. This gear 49 is seated upon the same shaft 29a as the gear or gear member 30. Upon actuation of the brake mechanism 42a there is braked the lap roller 2 by means of the transmission or gearing elements 47, 48, 49, 30, 31 and 32

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A lap winder for producing laps from slivers, comprising:

two rotatable lap rollers for supporting a lap during lap winding;

a transmission cooperating with the two rotatable lap rollers;

fiber material supply means for infeeding fiber material to the two rotatable lap rollers for forming the lap;

means for branching-off power from the transmission for driving the fiber material supply means in dependence upon operation of the two rotatable lap rollers;

a drive motor for driving the two rotatable lap rollers by means of said transmission; and at least one brake mechanism cooperating with at least one of the two rotatable lap rollers for stopping rotation of the two rotatable lap rollers, whereby, when the drive to said transmission from said drive motor is disengaged, said at least one brake mechanism is applied for preventing transmission or kinetic energy of the lap rollers and the lap supported thereupon to the drive motor upon braking of the lap rollers and the lap supported thereupon to a standstill, and thus minimizing loading of the transmission.

2. The lap winder as defined in claim 1, wherein:

said at least one of said lap rollers has a peripheral surface; and said at least one brake mechanism cooperates directly with said at least one of the two rotatable lap rollers by acting upon the peripheral surface thereof.

3. The lap winder as defined in claim 1, further including:

an element fixedly connected for rotation with said at least one of said two lap rollers; and said at least one brake mechanism cooperates with said at least one of the two rotatable lap rollers by acting upon said element fixedly connected for rotation with said at least one of said two lap rollers.

4. The lap winder as defined in claim 1, wherein:

said at least one brake mechanism comprises two brake mechanisms;

each brake mechanism cooperating with an associated one of the lap rollers;

each of said two lap rollers has a respective peripheral surface; and each of said two brake mechanisms cooperating directly with the associated one of said two rotatable lap rollers by acting upon the peripheral surface of the associated lap roller.

5. The lap winder as defined in claim 1, wherein:

said at least one brake mechanism comprises two brake mechanisms;

a respective element fixedly connected for rotation with an associated one of said two lap rollers; and each of said two brake mechanisms cooperating with associated ones of said two rotatable lap rollers by acting upon the element fixedly connected for rotation with the associated one of said two lap rollers.

6. The lap winder as defined in claim 1, wherein:

the fiber material supply means comprises a drafting arrangement for forming from slivers a batt for winding into a lap upon the two rotatable lap rollers.

7. The lap winder as defined in claim 1, wherein:

each of said lap rollers is provided with a shaft;

gears seated upon the shafts of the lap rollers; and means for operatively connecting said gears with one another.

8. The lap winder as defined in claim 7, wherein:

said operatively connecting means comprise an endless power transmitting element.

9. The lap winder as defined in claim 1, wherein:

each of said lap rollers is provided with a shaft;

gears seated upon the shafts of the two lap rollers;

said transmission including a common shaft having two gear members seated thereupon; and means for operatively connecting a respective one of the gears of the two lap rollers with a respective one of the gear members seated upon said common shaft.

10. The lap winder as defined in claim 9, wherein:

said operatively connecting means comprise respective endless power transmitting elements.

11. A lap winder for producing laps from slivers, comprising:

two rotatable lap rollers for supporting a lap during lap winding;

a transmission cooperating with the two rotatable lap rollers;

a drive motor for driving the two rotatable lap rollers by means for said transmission; and at least one brake mechanism cooperating with at least one of the two rotatable lap rollers for stopping rotation of the two rotatable lap rollers, whereby, when the drive to said transmission from said drive motor is disengaged, said at least one brake mechanism is applied for inhibiting transmission of kinetic energy of the lap rollers and the lap supported thereupon to the drive motor upon braking of the lap rollers and the lap supported thereupon to a standstill, and thus minimizing loading of the transmission.

* * * * *